US005661878A

United States Patent [19]

Johnson, III

[11] Patent Number: 5,661,878

[45] Date of Patent: Sep. 2, 1997

[54] STRAPPING SYSTEM AND BUCKLE THEREFOR

[75] Inventor: Walter M. Johnson, III, Tarpon Spring, Fla.

[73] Assignee: Net/Werk/USA, Inc., New York, N.Y.

[21] Appl. No.: 685,971

[22] Filed: Jul. 22, 1996

[51] Int. Cl.[6] ..... A44B 11/00

[52] U.S. Cl. ..... 24/200; 24/198

[58] Field of Search ..... 24/200, 197, 198, 24/265 BC, 265 AL

[56] References Cited

U.S. PATENT DOCUMENTS

| | | | |
|---|---|---|---|
| 2,058,931 | 10/1936 | Williams | 24/200 |
| 2,293,562 | 8/1942 | Rosenthal | 24/200 |
| 2,407,466 | 9/1946 | Alberts | 24/198 |
| 3,858,279 | 1/1975 | Brattstrom | 24/200 |
| 4,525,901 | 7/1985 | Krauss | 24/200 |
| 4,571,783 | 2/1986 | Kasai | 24/200 |
| 5,426,829 | 6/1995 | Hsiung | 24/200 |

FOREIGN PATENT DOCUMENTS

| | | | |
|---|---|---|---|
| 2612033 | 10/1976 | Germany | 24/200 |

*Primary Examiner*—Victor N. Sakran
*Attorney, Agent, or Firm*—Moonray Kojima

[57] ABSTRACT

A strapping system using a novel buckle werein one end portion of the buckle is attached to one end of a strap, and the other end of the strap is threaded through the buckle in such a manner that the strap is held securely in place. The buckle is of a unitary structure comprising the end portion and threading portion in which are located two outer parallel legs and a center leg with gaps therebetween, and wherein the center leg has roughened surfaces and edges which are 90° and one outer leg having a 90° edge and roughened surfaces so that the threaded strap contacts the 90° edges of the center leg and the 90° edge of the one outer leg so that the strap is securely held by the buckle.

3 Claims, 2 Drawing Sheets

FIG. 1
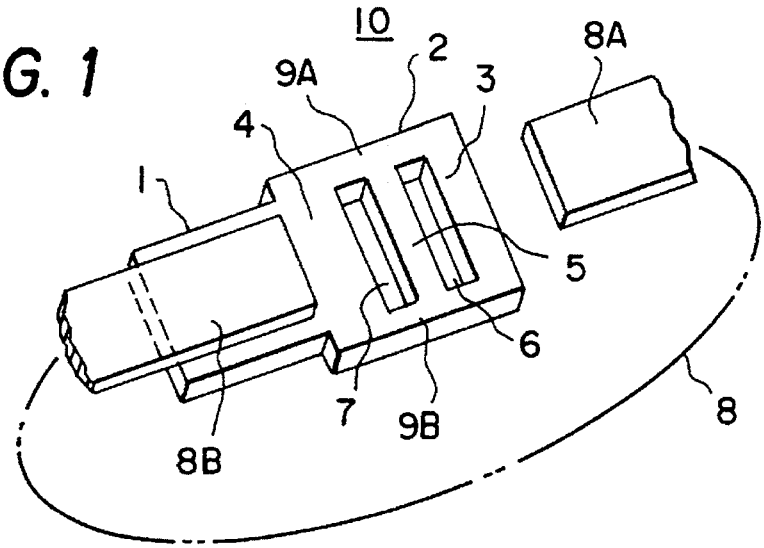
FIG. 2
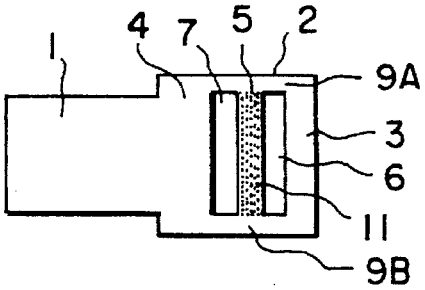
FIG. 4
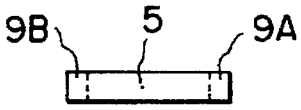
FIG. 5
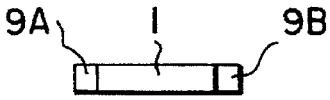
FIG. 3
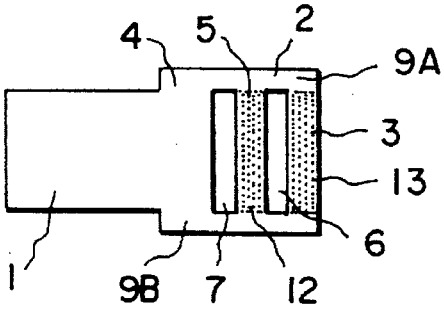
FIG. 6
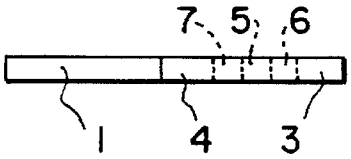
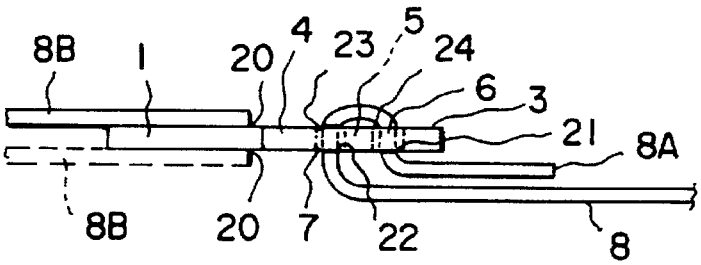
FIG. 7

FIG. 8
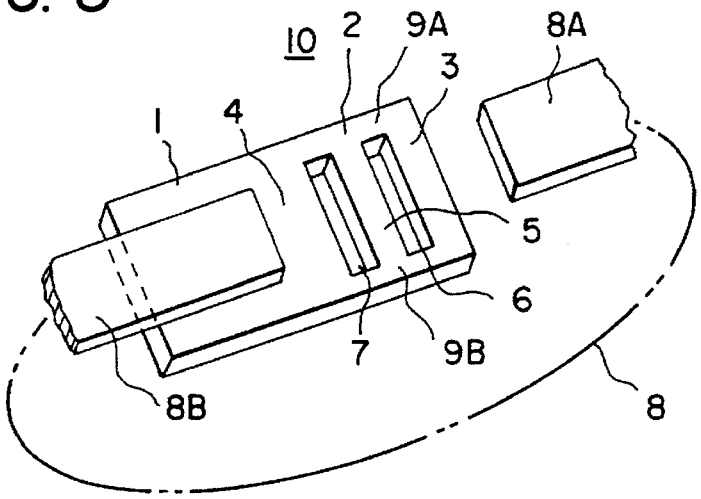
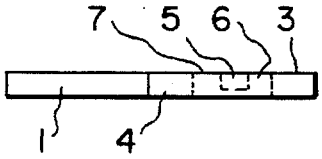
FIG. 9
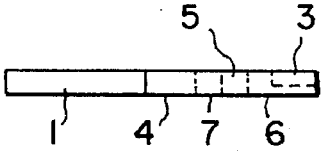
FIG. 10
FIG. 11
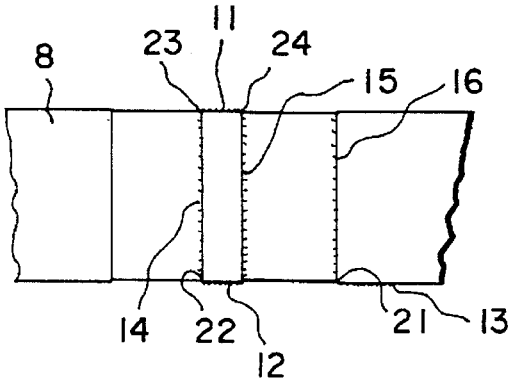

STRAPPING SYSTEM AND BUCKLE THEREFOR

BACKGROUND OF THE INVENTION

1. Field of Invention

This invention relates to a buckle and strap system; and more particularly, to improvements in the buckle used therefor.

2. Description of Related Art

A conventional strapping system may comprise a strap which is placed around a package being secured and then overlapped at its ends and sealed together using heat.

Another type uses a strap together with a buckle wherein the strap is threaded through the buckle at both ends, such as shown in copending patent application Ser. No. 08/625,231 filed Apr. 1, 1996.

There is, however, still a continuing search for improved buckles which can be manufactured more simply, more economically, and have good reliability.

SUMMARY OF THE INVENTION

Accordingly, an object of the invention is to overcome the aforementioned and other deficiencies and disadvantages of the prior at.

Another object is to provide a buckle which is of unitary structure, simple, reliable in operation, easy to operate, and inexpensive to manufacture.

BRIEF DESCRIPTION OF THE DRAWINGS

FIG. 1 is a perspective view depicting an illustrative embodiment of the invention.

FIG. 2 is a top view of the embodiment of FIG. 1.

FIG. 3 is a bottom view of the embodiment of FIG. 1

FIG. 4 is a rear view of the embodiment of FIG. 1.

FIG. 5 is a front view of the embodiment of FIG. 1.

FIG. 6 is a right side view of the embodiment of FIG. 1.

FIG. 7 is a right side view of the embodiment of FIG. 1, showing the threaded strap.

FIG. 8 is a perspective depicting another illustrative embodiment of the invention.

FIG. 9 is a right side view of a still further illustrative embodiment of the invention.

FIG. 10 is a right side view of a further illustrative embodiment of the invention.

FIG. 11 is an exploded view of the threaded part of the buckle of FIG. 7.

DETAILED DESCRIPTION OF PREFERRED EMBODIMENTS

FIGS. 1–7 show a buckle 10 to which is attached by heat sealing or welding, glueing, etc, one end 8B of a plastic strap 8, the other end 8A of strap 8 being threaded through buckle 10, as shown in FIG. 7, to securely hold strap 8, for example around a box.

The buckle which may be of plastic, hard rubber, etc, is of a unitary structure, such as formed by extrusion, stamping, etc, and comprises an attaching portion 1, and a threading portion 2, which comprises a pair of parallel outer legs 3,4 and a parallel center leg 5 with a pair of gaps or openings 6,7 therebetween and connected together by parallel side legs 9A,9B.

The attaching portion 1 may be narrower than the threading portion 2, as shown, for example, in FIG. 1, or the same width as shown in FIG. 8.

As shown in FIGS. 2,3,7 and 11, the bottom surfaces 12,13 of legs 5 and 3, are rough, the top surface 11 of center leg 5 is rough, the side surfaces 14,15 center leg 5 within gaps 6,7 are rough, and the innder side surface 16 of outer leg 3 is rough. The rough surfaces provide greater frictional force for holding securely strap 8 when treaded through the buckle as shown in FIG. 7.

Also, as shown in FIG. 7, and more detailedly in FIG.11, the edges 22,23,24 of center leg 5 formed by the respective sides thereof are set at 90°, and the edge 21 formed by the respective sides of outer leg 3 is also at 90°. The right angle or 90° angle causes the strap, when threaded as shown in FIG. 7, to form right angular changes of direction of strap 8 which results in a more secure holding of strap 8 by buckle 10.

The top and bottom surfaces of buckle 10 are substantially flat and planar. Thus, advantageously, the buckle can be readily formed of a flat piece of plastic by simple stamping operation, or by simple extrusion process. The embodiment of FIG. 8 is still simpler in that the different widths of the attaching portion and threading portion is eliminated, and only a single rectangular shape is used with the top and bottom surfaces being plane.

As shown in FIG. 7, the strap end 8B may be attached to attaching end 1 by means of heat sealing or welding, glueing using an appropriate sealant, etc. When heat sealing or welding, one or more welding ridges are formed in the attaching end top or bottom surface as desired. The ridges, welding bead, sealant, etc, are shown symbollically as number 20, in FIG. 7. As stated, the strap may be attached to the attaching portion 1 on the top surface or the bottom surface as desired.

Although the center leg 5 and outer legs 3 and 4 are shown in the embodiment of FIGS. 1 and 8 to be of about the same vertical dimension, they can also be of different dimensions, as shown in FIGS. 9 and 10. For example, as shown in FIG. 9, the center leg 5 may be shorter in vertical dimension than the outer legs 3,4. In FIG. 10, the outer leg 3 has a shorter vertical dimension than outer leg 4 and center leg 5. By using the shorter vertical dimension space is provided for the overlapped strap to lie flat with the buckle 10 disposed flat over the strap when threaded. Although not specifically shown, the top surfaces can be shortened instead of the bottom surfaces of the center leg and outer leg.

Also, the edges 21,22,23, and 24 are preferably sharply defined so as to more effectively catch the strap threaded next thereto. The sharpness of the edges 21,22,23,24 can extend slightly in a desired outward direction from the legs. Such sharpness can be readily built into a mold for example, a sharp spike at the corner, as symbollicy shown.

Advantageously, the unitary structure of the invention enables use of economical manufacturing techniques, and is simple, more reliable, more accurate, and enable usage of the buckle in a more efficient threading of the strap through the buckle, thereby increasing the commercial attractiveness of the product.

What is claimed is:

1. A buckle formed as a unitary structure consisting of:

an end portion formed of two substantially flat surfaces, one of which is prepared for attaching a strap; and a main portion connected to said end portion and having a substantially flat top surface and a substantially flat bottom surface, and consisting of two parallel parts connected perpendicularly to two parallel outer legs and a parallel center leg disposed between said two parallel outer legs thereby forming a pair of gaps therebetween;

said center leg being substantially rectangular in cross section and having two sides thereof of rough surfaces and three edges thereof formed by sides thereof, said three edges being at at substantially right angles;

one of said two parallel outer legs having an edge formed by sides thereof, said edge being at substantially right angles;

said gaps being of a width dimension substantially matching the width dimension of said strap, and of a thickness dimension substantially matching the thickness dimension of said strap;

wherein one end of said strap is threaded through said gaps as follows: first, under the bottom surface of said center leg, then, through said gap formed between said center leg and an outer parallel leg, then, above the top surface of said center leg, then through said gap formed between said center leg and the other of said two parallel outer legs, and then, below the bottom surface of said other of said two parallel outer legs, and between said bottom surface and said strap, so that said right angled edges contact and securely hold said strap.

2. The buckle of claim 1, wherein another end of said strap is attached to a bottom surface of said end portion.

3. The buckle of claim 1, wherein another end of said strap is attached to a top surface of said end portion.

* * * * *